US005203751A

United States Patent [19]

Chang

[11] Patent Number: 5,203,751

[45] Date of Patent: Apr. 20, 1993

[54] EXERCISE MECHANISM

[76] Inventor: Chester Chang, No. 1-5, Chun Ting Lane, Ya Tan Road, Ta Ya Hsiang, Taichung Hsien, Taiwan

[21] Appl. No.: 729,060

[22] Filed: Jul. 15, 1991

[51] Int. Cl.[5] ..... A63B 22/00

[52] U.S. Cl. ..... 482/70; 482/51

[58] Field of Search ..... 482/70, 51, 52, 53, 482/54, 62

[56] References Cited

U.S. PATENT DOCUMENTS 4,529,194 7/1985 Haaheim ..... 482/70

4,679,786 7/1987 Rodgers ..... 482/70

5,110,117 5/1992 Fisher et al. ..... 482/54

*Primary Examiner*—Stephen R. Crow

[57] ABSTRACT

An exercise device including a pair of tracks, a bracket slidably disposed on each of the tracks, a pair of rails disposed above the tracks, a slide slidably disposed on each of the rails, a handle coupled to each of the slides, and a cable threaded along the tracks and along the rails and formed into a closed loop. The brackets and the slides are coupled together by the cable so that the brackets and the slides move in concert.

2 Claims, 5 Drawing Sheets

EXERCISE MECHANISM

BACKGROUND OF THE INVENTION

1. Field of the Invention

The present invention relates to an exercise mechanism, and more particularly to an exercise mechanism for simulating the motions of skiing.

2. Description of the Prior Art

An exercise machine for simulating the motions of skiing is disclosed in U.S. Pat. No. 4,529,194 to Haaheim, filed Apr. 18, 1983, entitled "Cardiovascular Exercise Machine". In this exercise machine, the skate wheel brackets and the pole handles move individually and have no connecting or coupling devices provided therebetween for controlling the movement between the pole handles and the skate wheel brackets so that the exercise machine can not accurately simulate the motions of skiing.

The present invention has arisen to provide a novel exercise mechanism.

SUMMARY OF THE INVENTION

The primary objective of the present invention is to provide an exercise mechanism in which the movements between the handle slides and the foot brackets are linked together so that the exercise mechanism can accurately simulate the motions of skiing.

In accordance with one aspect of the invention, there is provided an exercise mechanism including a pair of tracks disposed in parallel on a base, a gear rotatably disposed between the front ends of the tracks, a belt engaged on the gear, a bracket slidably disposed on each of the tracks, a pair of rails having a lower end pivotally coupled to the base and having an upper end pivotally coupled together by a beam, a slide slidably disposed on each of the rails, a handle coupled to each of the slides, a pulley disposed on each end of each of the rails and a pulley disposed on a rear end of each of the tracks, and a cable threaded through the pulleys and having end portions coupled to the end portions of the belt so that the cable and the belt form a closed loop, the brackets and the slides being coupled to the cable such that the brackets and the slides are coupled together and such that the brackets and the slides move in concert.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
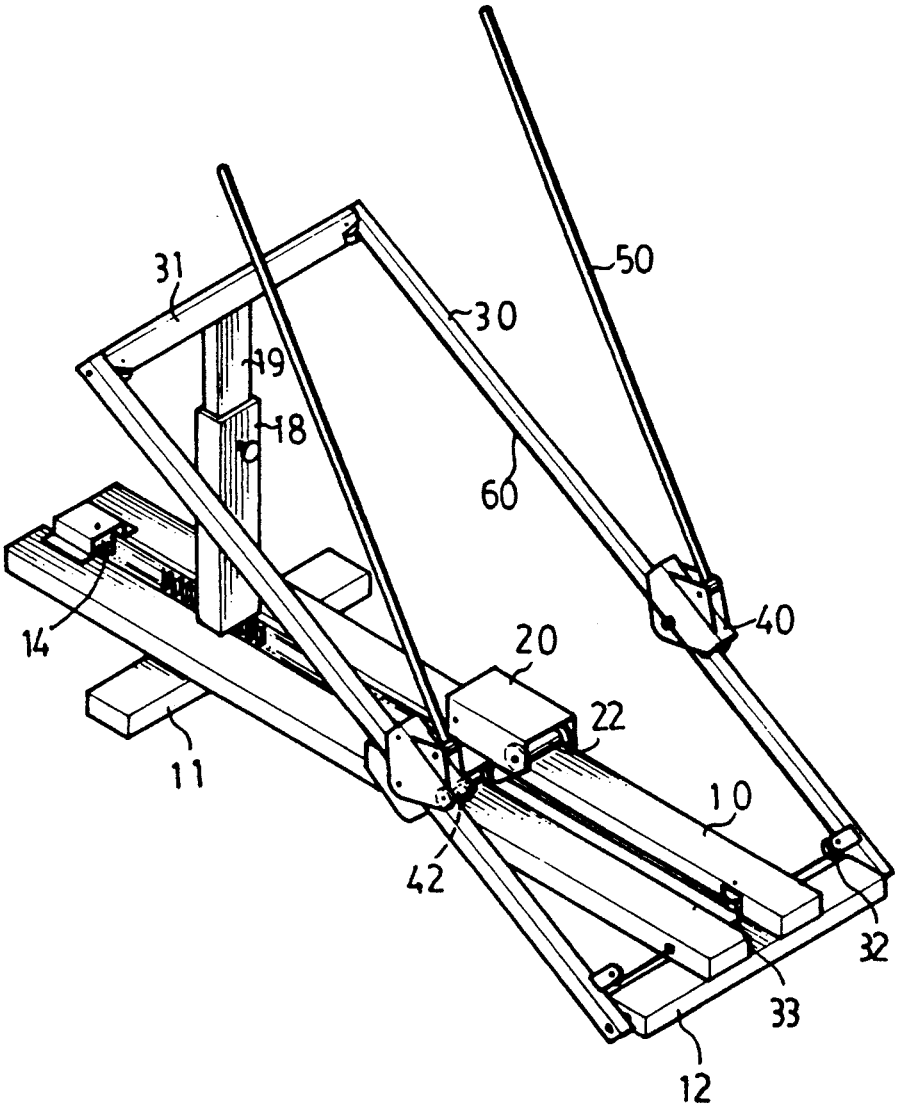
FIG. 1 is a perspective view of an exercise mechanism in accordance with the present invention.
Figure 2:
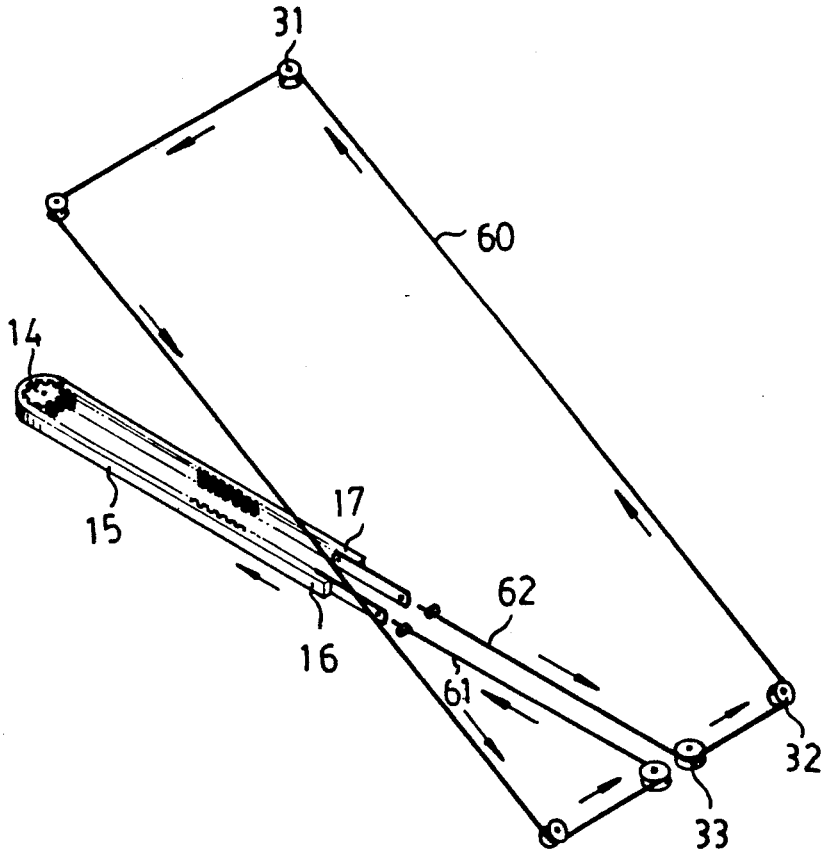
FIG. 2 is a schematic view illustrating the loop of cable of the coupling.
Figure 3:
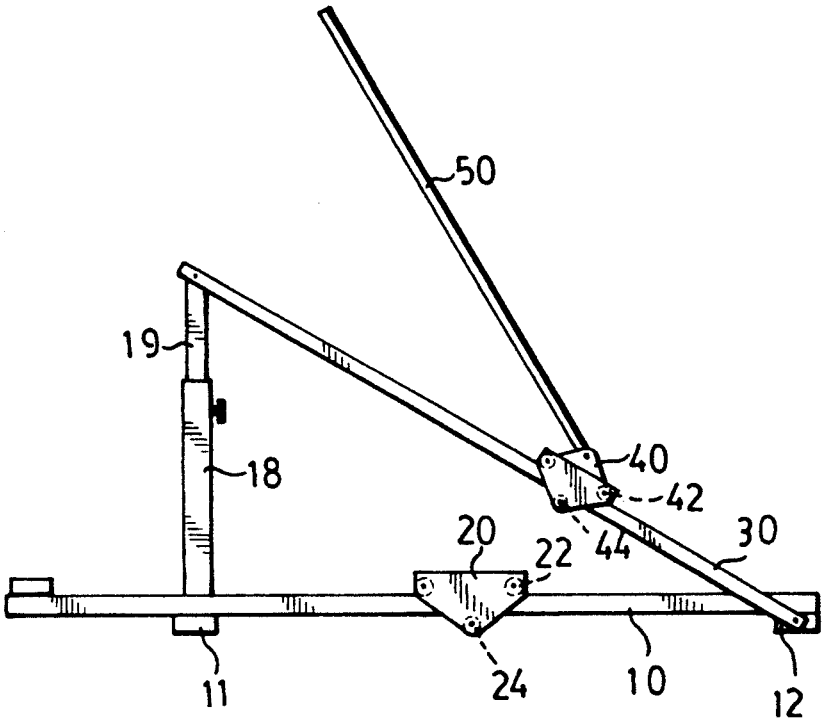
FIG. 3 is a side view of the exercise mechanism.

Referring to the drawings and initially to FIGS. 1, 2 and 3, an exercise mechanism in accordance with the present invention comprises generally a pair of tracks 10 fixed in parallel on a base which includes a pair of separated bars 11, 12, in which the front bar 11 is disposed in front of the rear bar 12; a foot bracket 20 slidably disposed on each of the tracks 10; a pair of rails 30 having a lower end pivotally coupled to the rear bar 12 and having a front end pivotally coupled together by a beam 31; a slide 40 is slidably disposed on each of the rails 30; and a handle 50 having a lower end pivotally coupled to each of the slides 40. The slides 40 and the brackets 20 are coupled together by a continuous cable 60 so that the slides 40 and the brackets 20 move in concert.

A gear 14 is rotatably disposed between the front ends of the tracks 10. A belt 15, such as a V-belt, is engaged with the gear 14 and includes two ends 16, 17. A post 18 is vertically fixed on the tracks 10 and is disposed above the front bar 11, and an extension 19 is slidably engaged in the post 18 and can be fixed in place by a bolt or the like. The beam 31 is fixed on the top of the extension 19. Three rollers 22, 24 are rotatably supported in each of the brackets 20, in which two of the rollers 22 are slidably disposed on the respective track 10 and the roller 24 is slidably disposed below the respective track 10 so that the brackets 20 are freely slidable along the respective tracks 10. Similarly, three rollers 42, 44 are rotatably supported in each of the slides 40, in which two of the rollers 42 are slidably disposed on the respective rail 30 and the roller 44 is slidably disposed below the respective rail 30 so that the slides 40 are freely slidable along the respective rails 30.

A pulley 32 is disposed on each end of each of the rails 30; and a pulley 33 is disposed in the rear end of each of the tracks 10. As shown in FIG. 2, the cable 60 is threaded through the pulleys 32, 33 and has its two ends 61, 62 coupled to the ends 16, 17 of the V-belt 15 so that the cable 60 and the belt 15 form a closed loop. The brackets 20 are coupled to the respective ends 61, 62 of the cable 60, and the slides 40 are coupled to the suitable positions of the cable 60 such that the slides 40 and the brackets 20 are coupled together by the cable 60 and such that the slides 40 and the brackets 20 move in concert.

Figure 4:
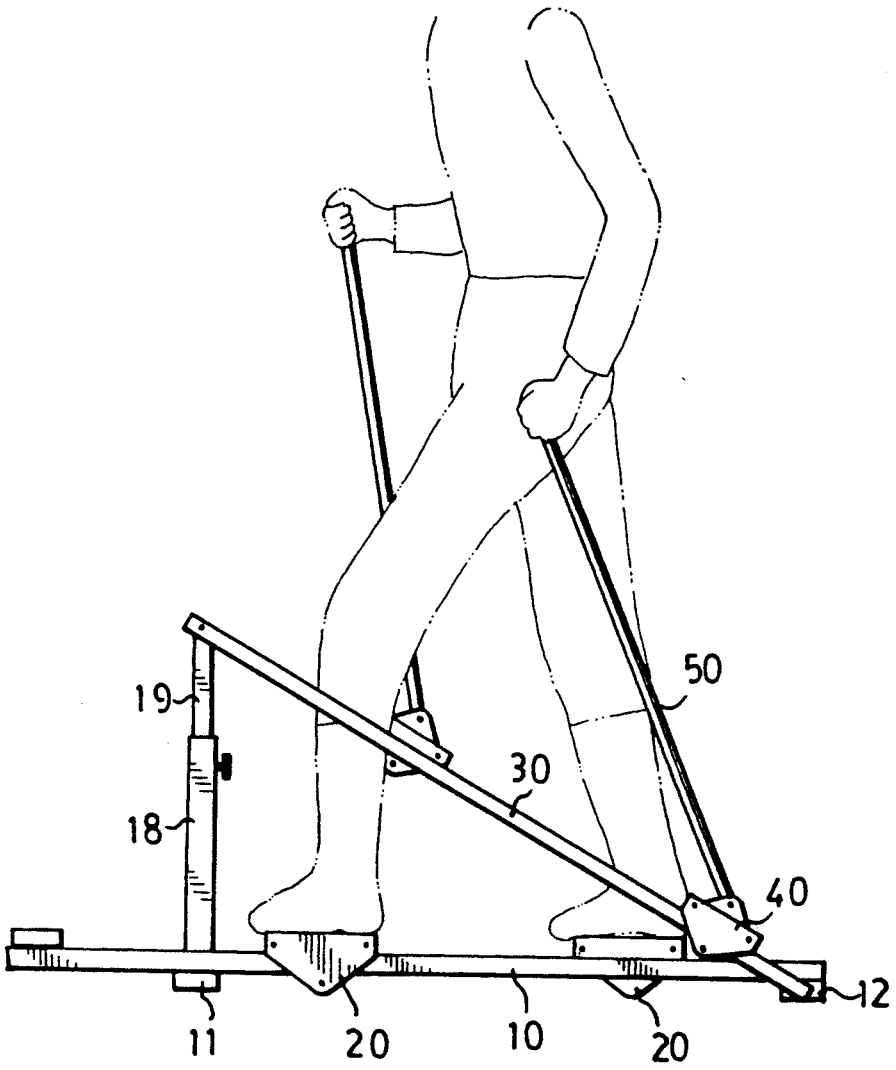
FIGS. 4 and 5 are schematic views illustrating the operations of the present invention.
Figure 5:
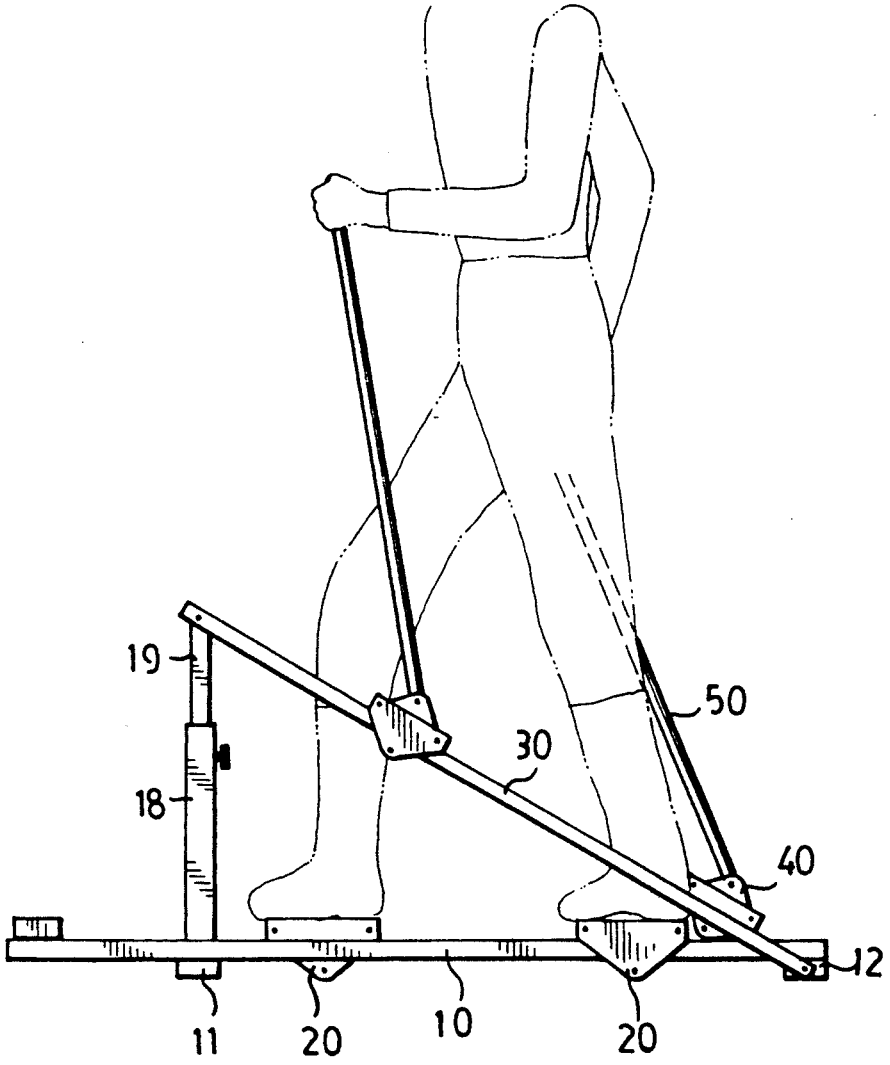

Referring next to FIG. 4 and again to FIG. 2, when the left foot of the user moves forward, the right foot of the user is caused to move rearward, simultaneously, the right hand of the user is caused to move forward, and the left hand of the user is caused to move rearward. On the contrary, as shown in FIG. 5, the left hand is caused to move forward when the right foot moves forward, so that the left foot moves rearward and the right hand moves rearward.

Accordingly, the handle slides and the foot brackets of the exercise mechanism in accordance with the present invention are coupled together so that the exercise mechanism can accurately simulate the motions of skiing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise mechanism comprising a pair of tracks disposed in parallel on a base; a gear rotatably disposed between a front end of said tracks; a belt engaged on said gear and including two end portions; a bracket slidably disposed on each of said tracks; a pair of rails having a lower end pivotally coupled to said base and having an upper end pivotally coupled together by a beam; a post vertically fixed on said tracks, said beam being disposed on a top of said post; a slide slidably disposed on each of said rails; a handle having a lower end pivotally coupled to each of said slides; a first pulley disposed on each end of each of said rails; a second pulley disposed on a rear end of each of said tracks; and a cable threaded through said first pulleys and said second pulleys and including two end portions coupled to said end portions of said belt so that said cable and said belt form a closed loop; said brackets being coupled to said end portions of said cable, and said slides being coupled to said cable such that said brackets and said slides are coupled together and such that said brackets and said slides move in concert.

2. An exercise mechanism according to claim 1, wherein an extension has a lower end slidably engaged in said post and can be fixed to said post, said beam is disposed on a top of said extension.

* * * * *